US010209042B2

(12) United States Patent
Baxter et al.

(10) Patent No.: US 10,209,042 B2
(45) Date of Patent: Feb. 19, 2019

(54) CARTRIDGE CASING

(71) Applicant: BAE SYSTEMS plc, London (GB)

(72) Inventors: James Edward Baxter, Crewe (GB); Joshua Matthew Stubbs, Crewe (GB); Nathan William Rowe, Crewe (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 15/516,189

(22) PCT Filed: Sep. 25, 2015

(86) PCT No.: PCT/GB2015/052784
§ 371 (c)(1),
(2) Date: Mar. 31, 2017

(87) PCT Pub. No.: WO2016/051140
PCT Pub. Date: Apr. 7, 2016

(65) Prior Publication Data

US 2017/0307343 A1 Oct. 26, 2017

(30) Foreign Application Priority Data

Oct. 1, 2014 (GB) ..... 1417312.4

(51) Int. Cl.

| | |
|---|---|
| ***F42B 5/29*** | (2006.01) |
| ***F42B 5/285*** | (2006.01) |
| ***F42B 5/307*** | (2006.01) |
| ***F42B 33/00*** | (2006.01) |
| ***B21K 21/04*** | (2006.01) |

(52) U.S. Cl.
CPC ..... *F42B 5/29* (2013.01); *B21K 21/04* (2013.01); *F42B 5/285* (2013.01); *F42B 5/307* (2013.01); *F42B 33/001* (2013.01); *F42B 33/00* (2013.01)

(58) Field of Classification Search
CPC .. F42B 5/29; F42B 5/307; F42B 5/285; F42B 33/00; B21K 21/04
USPC ..... 102/464
See application file for complete search history.

(56) References Cited

U.S. PATENT DOCUMENTS

| | | | | |
|---|---|---|---|---|
| 1,319,185 A | | 10/1919 | Smith et al. | |
| 2,294,822 A | | 9/1942 | Albree | |
| 2,823,611 A | * | 2/1958 | Thayer | F42B 5/285 102/469 |

(Continued)

FOREIGN PATENT DOCUMENTS

| | | |
|---|---|---|
| CA | 2813634 A1 | 4/2012 |
| DE | 306475 | 2/1920 |

(Continued)

OTHER PUBLICATIONS

International Preliminary Report on Patentability received for Patent Application No. PCT/GB2015/052784, dated Apr. 13, 2017. 7 pages.

(Continued)

*Primary Examiner* — Samir Abdosh
(74) *Attorney, Agent, or Firm* — Finch & Maloney PLLC

(57) ABSTRACT

A cartridge casing comprises a casing tube having a first end and a head cap. The first end of the casing tube abuts and is joined with the head cap such that an orifice in the first end of the casing tube is aligned with a passage in the head cap to define a flash passage. The head cap and casing tube are held together by a deformable member.

21 Claims, 5 Drawing Sheets

(56) References Cited

U.S. PATENT DOCUMENTS

| | | | | |
|---|---|---|---|---|
| 3,099,958 | A * | 8/1963 | Daubenspeck | F42B 5/307 102/449 |
| 3,312,168 | A | 4/1967 | Stadler et al. | |
| 3,874,294 | A * | 4/1975 | Hale | F42B 33/001 102/467 |
| 3,977,326 | A * | 8/1976 | Anderson | F42B 5/307 102/467 |
| 4,147,107 | A | 4/1979 | Ringdal | |
| 4,173,186 | A | 11/1979 | Dunham | |
| 4,546,704 | A | 10/1985 | Ballreich et al. | |
| 4,598,445 | A | 7/1986 | O'Connor | |
| 4,719,859 | A | 1/1988 | Ballreich et al. | |
| 4,726,296 | A | 2/1988 | Leshner et al. | |
| 5,046,428 | A | 9/1991 | Jungblut et al. | |
| 5,063,853 | A | 11/1991 | Bilgeri | |
| 7,213,519 | B2 | 5/2007 | Wiley et al. | |
| 8,561,543 | B2 * | 10/2013 | Burrow | F42B 5/307 102/466 |
| 8,763,535 | B2 | 7/2014 | Padgett | |
| 9,551,557 | B1 | 1/2017 | Burrow | |
| 2007/0214922 | A1 | 9/2007 | Dittrich | |
| 2013/0186294 | A1 | 7/2013 | Davies et al. | |
| 2014/0060372 | A1 | 3/2014 | Padgett | |
| 2014/0224144 | A1 | 8/2014 | Neugebauer | |
| 2015/0241183 | A1 | 8/2015 | Padgett et al. | |
| 2017/0299351 | A1 | 10/2017 | Baxter et al. | |
| 2018/0209769 | A2 | 7/2018 | Baxter et al. | |

FOREIGN PATENT DOCUMENTS

| | | | |
|---|---|---|---|
| DE | 3704792 | A1 | 9/1988 |
| DE | 3923461 | A1 | 1/1991 |
| EP | 0186904 | A1 | 7/1986 |
| EP | 2543954 | A1 | 1/2013 |
| FR | 812581 | A | 5/1937 |
| FR | 2376395 | A1 | 7/1978 |
| GB | 313560 | | 5/1929 |
| GB | 469370 | A | 7/1937 |
| GB | 574877 | | 11/1942 |
| GB | 753830 | | 8/1956 |
| GB | 786627 | | 11/1957 |
| GB | 1015516 | | 1/1966 |
| GB | 1549864 | | 8/1979 |
| WO | 2008091245 | A2 | 7/2008 |
| WO | 2016051139 | A1 | 4/2016 |
| WO | 2016051140 | A1 | 4/2016 |

OTHER PUBLICATIONS

International Preliminary Report on Patentability received for Patent Application No. PCT/GB2015/052783, dated Apr. 13, 2017. 7 pages.

International Search Report and Written Opinion received for Patent Application No. PCT/GB2015/052784, dated Dec. 9, 2015. 11 pages.

International Search Report and Written Opinion received for Patent Application No. PCT/GB2015/052783, dated Dec. 21, 2015. 11 pages.

GB Intellectual Property Office Search Report under Section 17(5) received for GB Patent Application No. 1417312.4 dated Dec. 1, 2014. 3 pages.

GB Intellectual Property Office Search Report under Section 17(5) received for GB Patent Application No. 1417311.6 dated Nov. 28, 2014. 3 pages.

Non Final Office Action received for U.S. Appl. No. 15/516,191, dated Aug. 24, 2017. 13 pages.

Final Office Action received for related U.S. Appl. No. 15/516,191, dated Dec. 21, 2017. 14 pages.

Non Final Office Action received for related U.S. Appl. No. 15/516,191, dated Mar. 26, 2018. 16 pages.

* cited by examiner

CARTRIDGE CASING

The present disclosure relates to a cartridge casing.

In particular it relates to a cartridge casing for a projectile.

BACKGROUND

A conventional cartridge casing 10 is shown in FIG. 1. The cartridge assembly 10 comprises a casing 12 and a projectile 14. The casing 12 has a hollow section 16 which will contain propellant for displacement of the projectile 14. The casing 12 further comprises a head 18 at the end opposite to the projectile 14 which comprises a chamber 20 for a percussion cap, and a flash tube 22 for communication of an ignition charge from the percussion cap to the inside of the casing 12 and thus the propellant. The walls of the chamber 16 are formed integrally with the head 18. Such a cartridge casing may typically be formed of brass. This material choice has many advantages, for example, it is relatively easy to form into the desired shape. However, brass has demerit in that it is also relatively dense, and hence the casing 12 forms a relatively large percentage of the mass of the whole cartridge.

It is beneficial to reduce the mass of cartridges in order to reduce transport costs and mass burden on soldiers who carry them.

Hence a cartridge case, and a method of manufacture of a cartridge case which is of a relatively light weight construction is highly desirable.

SUMMARY

According to the present disclosure there is provided an apparatus and method as set forth in the appended claims. Other features of the invention will be apparent from the dependent claims, and the description which follows.

Accordingly there may be provided a cartridge casing comprising: a casing tube having a first end and a head cap, wherein the first end of the casing tube abuts and is joined with the head cap such that an orifice in the first end of the casing tube is aligned with a passage in the head cap to define a flash passage; and the head cap and casing tube are held together by a deformable member.

The deformable member may be provided with at least one deformable region which is deformable between: a first shape in which the deformable member may extend between the casing tube and head cap during assembly; and a second shape which fixes the casing tube and head cap together.

The deformable member may be integrally formed with the head cap.

The deformable member may extend through the passage in the head cap and through the first end orifice to thereby define the flash passage.

A seal material may be provided between first end of the casing tube and head cap.

The first end of the casing tube may comprise a ring shaped corrugation which encircles the orifice.

The first end of the casing tube may have a flat base and comprise a ring shaped corrugation which encircles the orifice, and the corrugation may extend from the base in a direction away from the head cap to define an annular gap between the casing tube base and head cap.

The casing tube may predominantly comprises a first material; and the head cap may predominantly comprises a second material different to the first material.

There may be provided a cartridge comprising a projectile mounted to a cartridge casing according to the present disclosure.

There may also be provided method of manufacturing a cartridge casing comprising the steps of: forming a casing tube by a first process; forming a head cap by a second process; and joining the casing tube and head cap by third process.

The first process may comprise the steps of: providing a material sheet; and deforming the material sheet into a substantially cylindrical tube such that the cylindrical tube is closed at a first end and open at a second end opposite to the first end, and providing an orifice in the first end.

The third process may comprise the steps of: providing a deformable region on the head cap configured to pass through the orifice in the first end of the casing tube; and deforming the deformable region to fix the casing tube and head cap together.

The third process may comprise the steps of: providing a deformable member which extends through the orifice in the first end of the casing tube and the head cap passage, and deforming the deformable member to fix the casing tube and head cap together.

Hence there is provided a light weight cartridge casing configuration and method of manufacture for a light weight cartridge casing.

BRIEF DESCRIPTION OF THE DRAWINGS

Examples of the present disclosure will now be described with reference to the accompanying drawings, in which.

DETAILED DESCRIPTION

Figure 2:
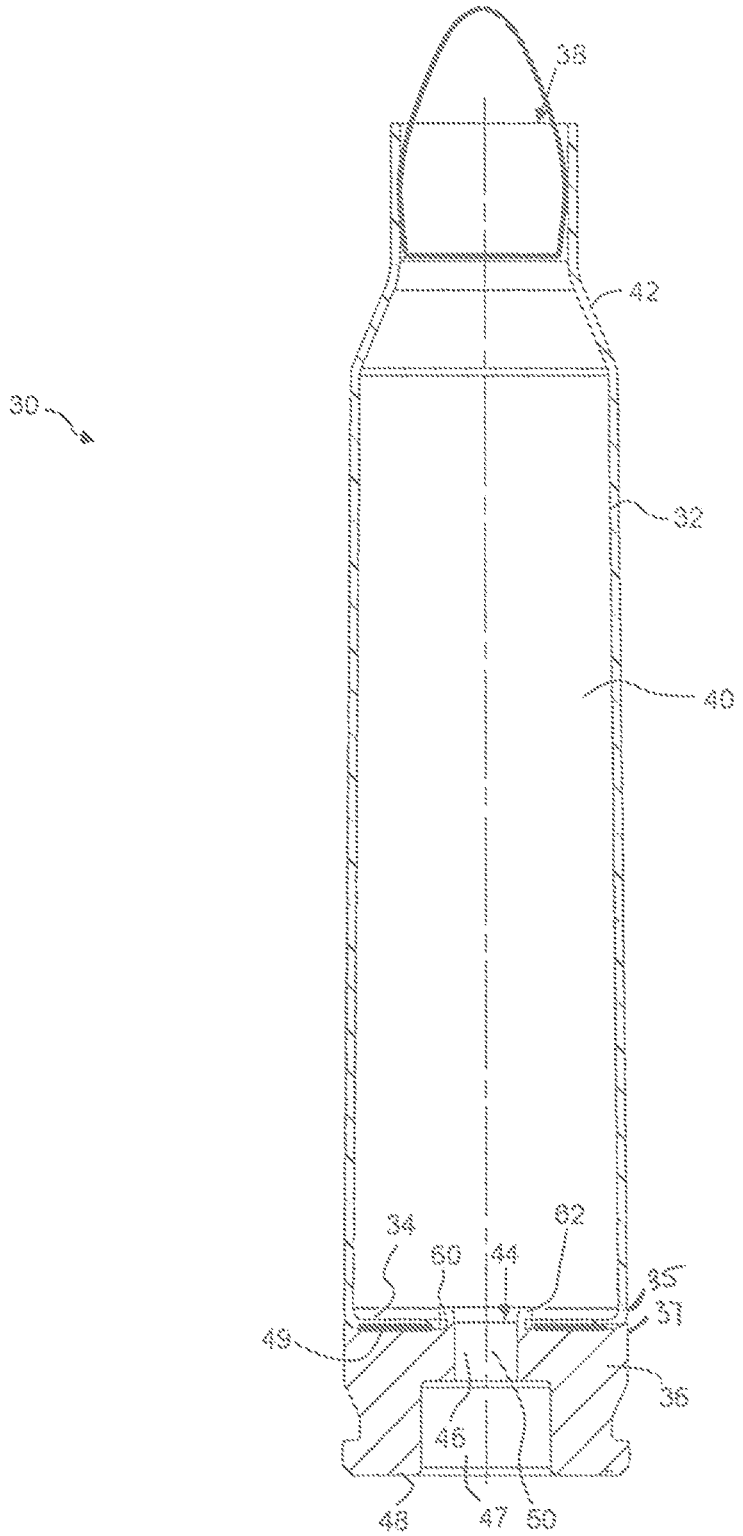
FIG. 2 shows an example of a cartridge casing according to the present disclosure.

FIG. 2 shows an example cartridge casing 30 according to the present disclosure. The cartridge casing 30 is configured for use in a rifled barrel of a gun, firearm or other such weapon.

The cartridge casing 30 comprises a casing tube 32 having a first end 34 which forms a base of the casing tube 32. The walls of the casing tube 32 turn at a corner edge 35 to define the first end 34. The corner edge 35 may have a radiussed, or arcuate, cross-section, as shown in FIG. 2.

The casing tube 32 abuts at least part of a head cap 36 provided adjacent the first end 34. The head cap 36 is configured to support and reinforce the base of the casing tube 32 to prevent it from swelling and rupturing during operation. In part it achieves this by providing reinforcement to the end wall of the casing tube 32 which abuts the head cap 36.

Additionally, the head cap 36 is provided with a shoulder edge 37. The shoulder edge 37 may be formed integrally with the head cap 36. The shoulder edge 37 is provided towards the outer edge of head cap 36, and extends in a longitudinal direction away from the head cap 36. The shoulder edge 37 may have a radiussed, or arcuate, cross-section. The corner edge 35 and shoulder edge 37 may be complementary in shape.

The corner edge 35 and shoulder edge 37 are sized and configured such that when the first end 34 of the casing tube 32 is seated on the head cap 36, the corner edge 35 of the casing tube 32 sits within the space, or region, defined by the shoulder edge 37 of the head cap 36. That is to say, the corner edge 35 and shoulder edge 37 are sized and configured such that when the first end 34 of the casing tube 32 is seated on the head cap 36, the shoulder edge 37 of the head cap 36 surrounds, encircles and/or bounds the corner edge 35 of the casing tube 32. Put another way, when the first end 34 of the casing tube 32 is fitted and located on the head cap 36, the shoulder edge 37 of the head cap 36 is substantially in contact with the whole of the circumference of corner edge 35 of the casing tube 32, and the shoulder edge 37 is configured to support loads induced in it by expansion of the casing. Thus, in operation, the shoulder edge 37 of the head cap 36 prevents the corner edge 35 of the casing tube 32 from moving radially outwards, for example beyond its original circumference or the circumference of the head cap 36.

Figure 1:
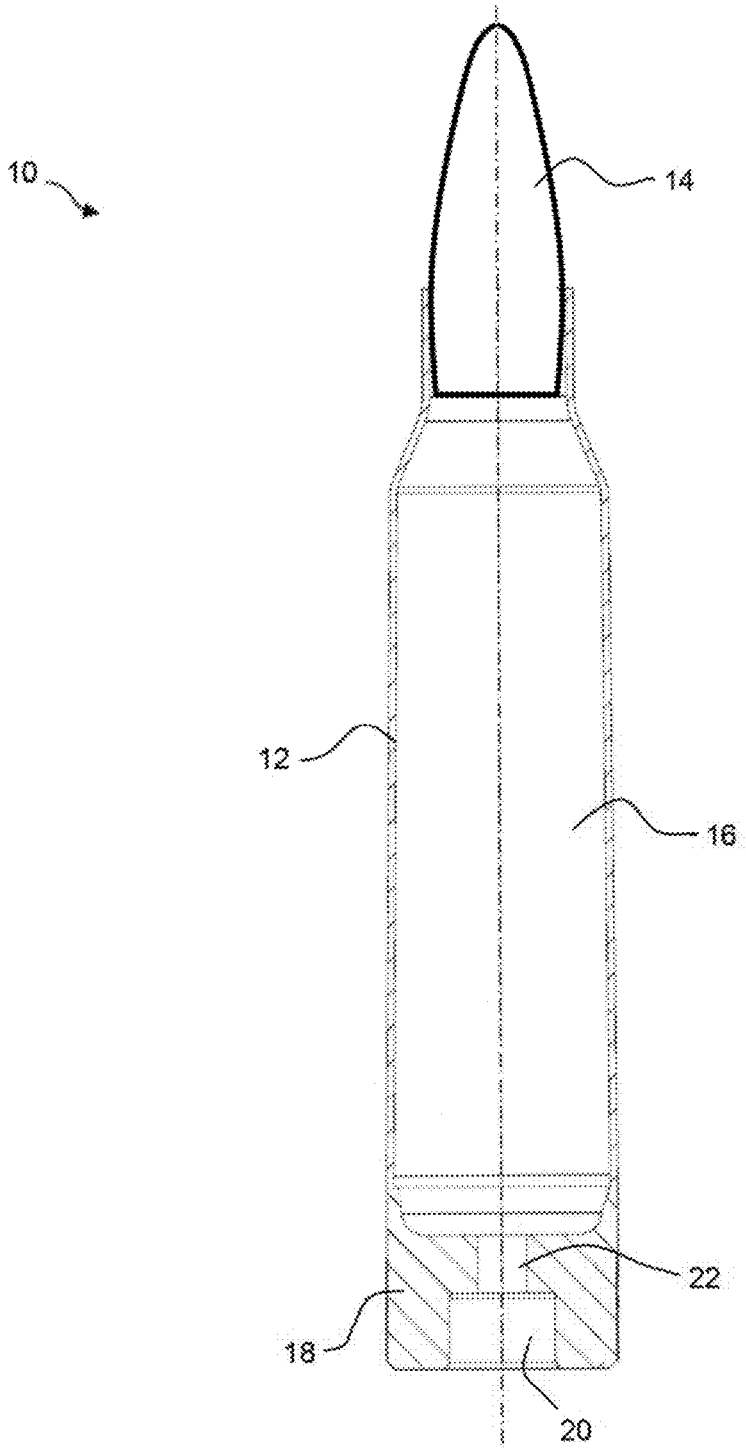
FIG. 1 shows a conventional cartridge casing, as described previously.

The casing tube 32 further comprises a second end 38, which is open and configured to receive a projectile (as shown in FIG. 1) opposite to the first end 34. The second end 38 has a diameter which may be substantially the same as, or less than, the diameter of the first end 34. In the example shown the diameter of the second end 38 is substantially less than the diameter of the first end 34.

The walls of the casing 32 define a substantially cylindrical thin walled chamber 40. The walls of the casing tube 32 are configured to contain a pressure in the chamber of up to about 500 MPa. The tube casing 32 has a substantially constant diameter along a first region of its length between the first end 34 and the second end 38. However, the cylindrical thin walled chamber 40 may have a taper (for example <1°) along at least part or all of its length. That is to say, although having a substantially constant diameter along its length, the diameter of the casing 32 may decrease slightly in a direction away from the first end 34, reducing in diameter from the first end 34 to the second end 38.

The casing tube 32 also comprises a transition region 42 towards or at the second end 38 wherein the transition region 42 of the casing tube 32 reduces in diameter in a direction away from the first end 34 to the second end 38. Hence the diameter of the casing tube 32 will be different on either side of the transition region 42. The diameter of the casing tube 32 is substantially constant along its length to either side of the transition region 42. The casing tube 32 is provided with an orifice 44 in the first end 34. In the example shown in FIG. 2 the first end 34 forms a flat bottom to the casing tube 32.

The head cap 36 defines a passage 46 which extends all of the way through the head cap 36 which in use will be a flash tube. The flash tube extends into a chamber 47 which, in use, will house a percussion cap (sometimes referred to as a "primer"). Thus the head cap 36 has a percussion side 48 which, in use, faces away from the casing tube 32. The orifice 44 in the first end 34 of the casing tube 32 and head cap passage 46, when assembled in alignment, define a flash passage 50 which extends between the head cap percussion side 48 and the inside of the casing tube 32.

The head cap 36 and casing tube 32 are held together by a deformable member 60. The deformable member 60 extends from the passage 46 of the head cap 36 through the orifice 44 in the first end 34 of the casing tube 32 and aligns the passage 46 with the orifice 44.

In the example of FIG. 2 the deformable member 60 is provided as at least one deformable end, lip or region 62, which is deformable between a first shape (for example an undeformed configuration or state) in which the deformable member 60 may extend from the head cap 36 through the casing tube 32 during assembly, and a second shape (for example a deformed configuration or state) which fixes the casing tube 32 and the head cap 36 together. The deformable member 60 thus provides a mechanical joint between the head cap 36 and casing tube 32.

In the example of FIG. 2 the deformable member 60 is integrally formed with the head cap 36. The deformable member 60 is deformable by swaging the region of the lip 62 which extends beyond the wall which defines the orifice 44 of the casing tube 32 such that the lip 62 becomes pressed against the wall of the casing tube 32 and draws the head cap 36 toward the base of the casing tube 32 to thereby clamp the casing tube 32 and head cap 36 together.

Figure 3:
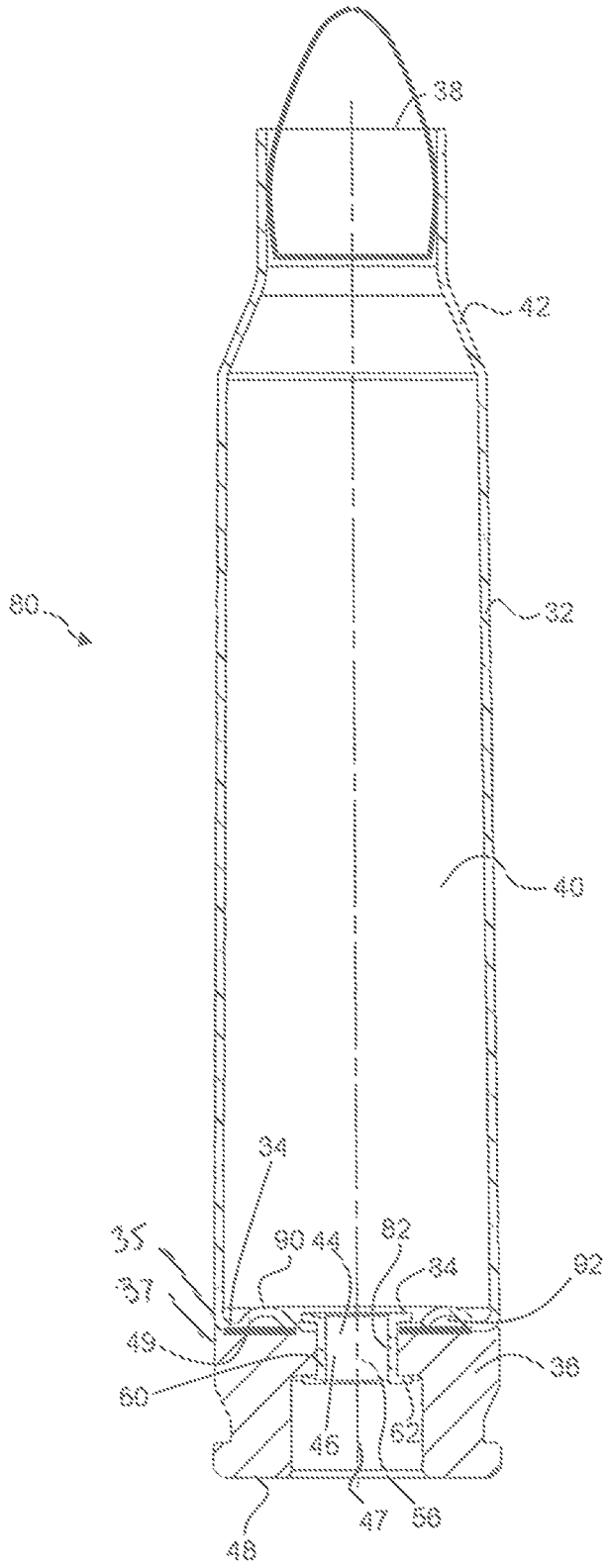
FIG. 3 shows an alternative example of a cartridge casing according to the present disclosure.

An alternative example of a cartridge casing 80 according to the present disclosure is shown in FIG. 3. The example of FIG. 3 is similar in many ways to the cartridge case shown in, and as described with reference to, FIG. 2. Features common to the examples of FIG. 2 and FIG. 3 are referred to using the same reference numerals.

In the FIG. 3 example the deformable member 60 is provided as a rivet like element 82 which is provided separately to the head cap 36 and casing tube 32. The deformable member 82 is cylindrical, hollow and thin walled. The deformable member 82 (rivet) extends along the passage 46 in the head cap 36 and through the orifice 44 in the first end of the casing tube 32. The deformable member 82 is provided with at least one deformable end, or lip, 62 which is deformable between a first shape (for example an undeformed configuration or state) in which the deformable member 82 may extend between the casing tube 32 and the head cap 36 during assembly, and a second shape (for example a deformed configuration or state) which fixes the casing tube 32 and head cap 36 together. For example, the deformable end 62 of the deformable member 82 may be swaged to bring the head cap 36 and casing tube 32 into a fixed relationship relative to one another.

The deformable end 62 of the deformable member 82 may take the form of a region of material which is configured to extend beyond the orifice 44 and passage 46 into the percussion cap chamber 47, which may then be swaged to form a clamping flange. Alternatively the deformable end 62 may be configured to extend into the casing tube 32. In such examples the deformable member 82 may be provided with a shoulder 84 of greater diameter than the orifice 44 and passage 46, on the opposite end of the deformable member 82 to the deformable region 62, such that the deformable member 82 is trapped against one side of the orifice 44 and passage 46.

Alternatively, a deformable end 62 may be provided at both ends of the deformable member 82 such that both end regions of the deformable member 82, that is to say the region which extends into the percussion cap chamber 47 and the region the extends into the casing tube 32, may be deformed to clamp against the end cap 36 and the casing tube 32 respectively.

Put another way, the deformable member 82 is deformable by swaging either the region of a lip 62 which extends beyond the wall which defines the orifice 44 of the casing tube 32 and/or by swaging the region of a lip 62 which extends beyond the flash tube 44 into the percussion cap chamber 47. Swaging causes the lip 62 to become pressed against the wall of the casing tube 32 and/or head cap 36 to thereby draw the head cap 36 toward the base of the casing tube 32 to thereby clamp the casing tube 32 and head cap 36 together.

In the example of FIG. 3, the first end 34 of the casing tube 32 comprises a ring shaped corrugation 90 which encircles the flash tube orifice 44 of the casing tube 32. That is to say, the first end 34 of the casing tube 32 may be provided with a ring shaped corrugation 90, where the corrugation may be provided as a convolution or cannelure, which encircles the flash tube orifice 44 in the first end 34 of the casing tube 32. The corrugation 90 extends away from the base formed by the first end 34 in a direction away from the head cap 36 to define an annular gap 92 between the casing tube base 34 and head cap 36. This corrugation 90 provides an expansion feature for the casing 32 during operation of the cartridge casing. The corrugation may be also provided in the example of FIG. 2.

The casing tube 32 and head cap 36 may predominantly comprise the same material. Alternatively the casing tube 32 may predominantly comprise a first material and the head cap 36 predominantly comprises a second material different to the first material. The deformable member 60 of the FIG. 3 example may comprise the first material, the second material or a third material different to the first material and the second material.

The casing tube 32 and head cap 36 may be formed from a metal, metallic material or metal alloy comprising, for example, aluminium or a titanium. In one example the casing tube 32 and head cap 36 may comprise ferritic alloys, for example stainless steel. The casing tube 32 and head cap 36 may alternatively be formed from non metallic material and/or metal-plastic composite material. The casing tube 32 and head cap 36 may be made of the same or dissimilar materials. The deformable member 60, i.e. the rivet 60, may be made of the same or a different material to the tube casing 32 or head cap 36, for example stainless steel, titanium, brass or coated mild steel.

Figure 4:
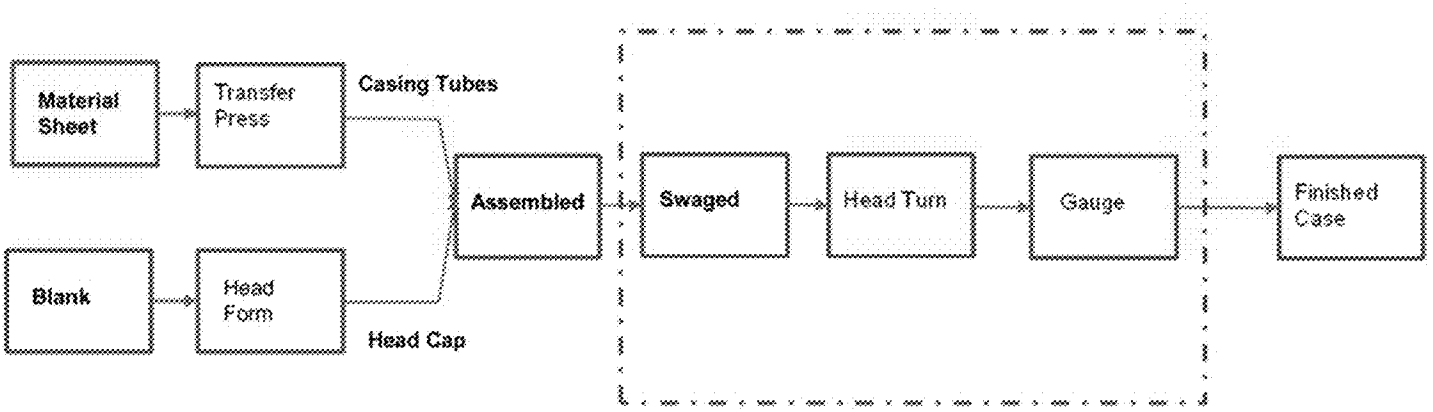
FIG. 4 shows an example process for the manufacture of a cartridge casing according to the present disclosure.
Figure 5:
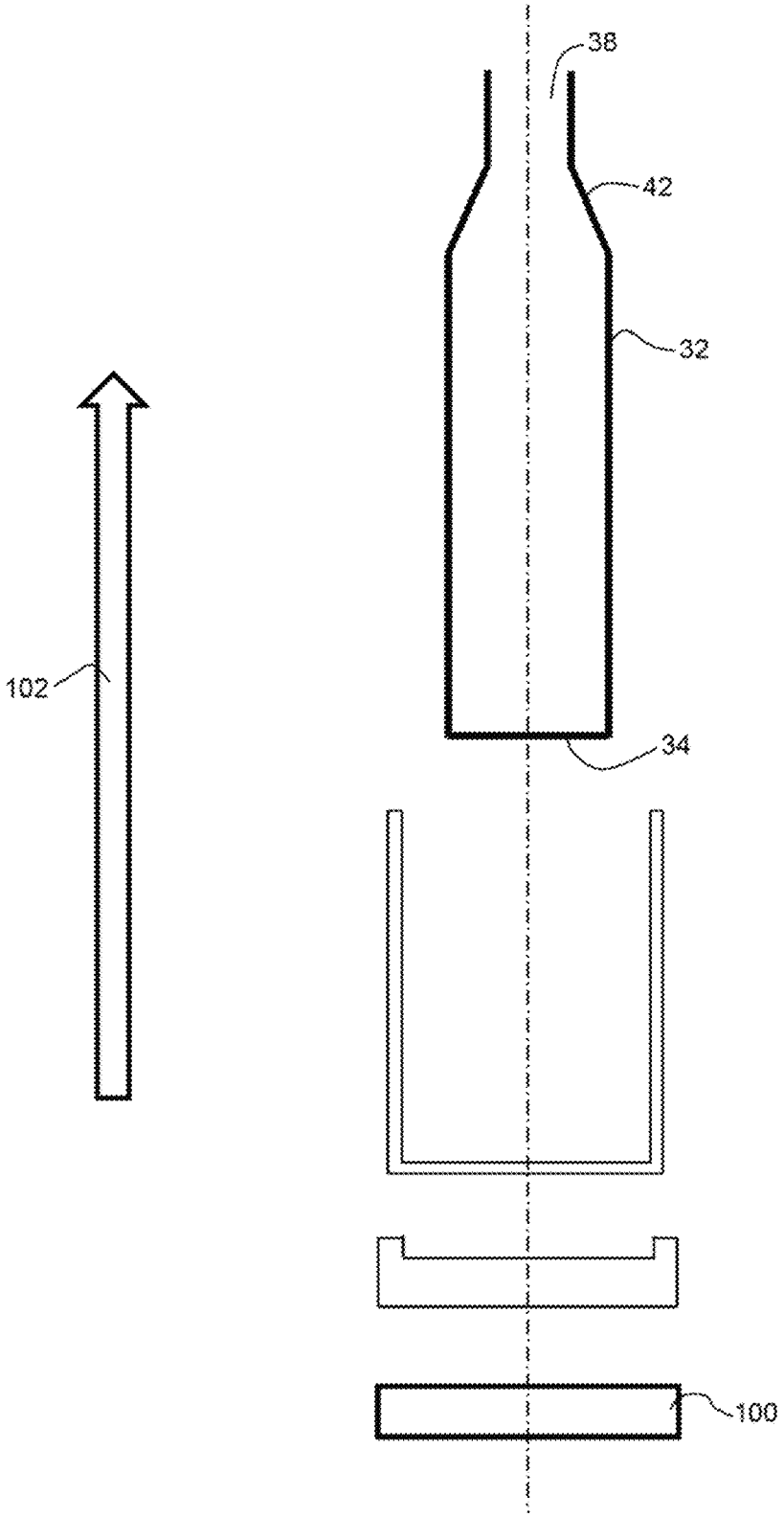
FIG. 5 shows an example forming process for a casing tube of the cartridge casing of the present disclosure.

The method of manufacture of a cartridge casing according to the present disclosure and as shown in FIG. 2 and FIG. 3 comprise the steps of forming a casing tube 32 by a first process, forming a head cap 36 by a second process and joining the casing tube 32 and head cap 36 by a third process. This is described as a flow diagram in FIG. 4. FIG. 5 shows the forming of the casing tube 32 in more detail.

A material sheet 100, for example a stainless steel strip 100, is formed on a transfer press into a tapered casing tube 32 as shown in FIG. 5. In an independent process a stainless steel wire, or blank of material, is machined and/or formed into a cylindrical head cap 32, perhaps by a cold forming process. The casing tube 32 and head cap 36 are joined in a third independent process, after the casing tube 32 and head cap 36 are assembled with the feature of a deformable member 60,82, which either extends from the head cap 36 as shown in FIG. 2 or provided as a separate component as described with reference to FIG. 3. The deformable regions 62 of the deformable member 60 are then swaged to clamp the head cap 36 and casing tube 32 together. The assembly is then gauged to ensure it meets the correct dimensional tolerances.

The material sheet 100 which may be deformed in a series of steps, shown in sequence from the bottom to the top of the page on FIG. 5 in the direction shown by the arrow 102. Although details of the process may vary, the material is gradually formed through intermediate stages in which the features of the casing tube 32 are provided. The thin walls of the cylindrical tube 32 are drawn from the material strip 100, during which process the tapered transitional region 42 may be formed. The material sheet 100 is deformed such that the cylindrical tube is closed at the first end 34 and open at the second end 38 opposite to the first end 34. The orifice 44 is provided in the closed/first end 34 by drilling or other forming method. The transition region 42 of the cylindrical tube 32 is tapered towards the second end 38 such that the second end has a diameter less than that of the first end 34.

The second process, for forming the head cap 36 comprises the step of providing the blank of material, machining and/or forming the material blank into the cylindrical head cap 36 such that the head cap has an external diameter substantially identical to the external diameter of the casing tube, although it may be formed with an external diameter slightly greater than the external diameter of the casing tube. A passage 46 is provided in the head cap 36 which extends all the way through the head cap 36.

With reference to the example of FIG. 2, the deformable region 60 may be provided on the head cap 36 which is configured to pass through the orifice 44 in the first end 34 of the casing tube 32. For the cartridge casing example of FIG. 2, the third process comprises the steps of deforming the deformable region 60 to fix the casing tube 32 and head cap 36 together. A sealing material 49, for example a sealing member, sealant or gasket may be provided between the mating surfaces of the head cap 36 and casing tube 32 to provide an environmental seal and seal against escape of high pressure propellant gases during operation, (i.e. on firing of the cartridge casing).

Alternatively, as shown in FIG. 3 the deformable member 60 may be provided as a rivet 60 which extends through the orifice 44 in the first end 34 of the casing tube 32 and also extends through the flash tube passage 46 in the head cap 36. The rivet 60 is then deformed at one or both ends by swaging the rivet to provide a clamping force to draw the casing tube 32 and head cap 36 together into a clamped relationship.

The head cap 36 may be turned, or cold formed, or any other appropriate method for the forming of a head cap 36.

After being fixed together, the head cap 36 may be turned to centre it on the casing tube 32, and to provide any other additional features required for successful functioning of the casing.

Thus there is provided a thin cartridge casing with a thin wall casing tube which is made of a material which is inherently lighter than conventional cartridge cases. The material choice enables the casing tube to withstand the ignition pressures induced during operation whilst also being made by a reliable and repeatable manufacturing process. Since the casing may have a thinner wall than that of the related art, and is made of a material which has a lower density than that used for conventional casings, the resultant cartridge casing will overall be lighter than an equivalent conventional casing. Hence for a given amount of powder propellant, a cartridge having a casing of the present disclosure will produce the same performance for less overall cartridge mass than a conventional cartridge assembly. Additionally, a cartridge casing of the present disclosure may contain a larger volume of powder propellant for delivering the projectile over a further distance or with greater force than a conventional cartridge, and yet, when assembled, be of the same or lower mass than a conventional cartridge.

While the cartridge cases have been described with reference to propelling a projectile, the techniques and materials described may also be used in the production of a blank cartridge case, for example one used to contain only a charge but no projectile.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A cartridge casing comprising:

a casing tube including a metal or a metal alloy, the casing tube having a turn at a first end to provide a corner edge with an arcuate cross-section, wherein walls of the casing tube turn at the corner edge to define the first end of the casing tube; and a head cap provided with an integral shoulder edge;

wherein the first end of the casing tube abuts and is joined with the head cap such that the corner edge of the casing tube sits within the shoulder edge of the head cap;

wherein an orifice in the first end of the casing tube is aligned with a passage in the head cap to define a flash passage; and wherein the head cap and casing tube are held together by a deformable member which provides a mechanical joint between the head cap and casing tube.

2. The cartridge casing of claim 1 wherein the deformable member is provided with at least one deformable region which is deformable between:

a first shape in which the deformable member may extend between the casing tube and head cap during assembly; and a second shape which fixes the casing tube and head cap together.

3. The cartridge casing of claim 1 wherein the deformable member is integrally formed with the head cap.

4. The cartridge casing of claim 1 wherein the deformable member extends through the passage in the head cap and through the first end orifice to thereby define the flash passage.

5. The cartridge casing of claim 1 wherein a seal material is provided between first end of the casing tube and head cap.

6. The cartridge casing of claim 1 wherein the first end of the casing tube comprises a ring shaped corrugation which encircles the orifice.

7. The cartridge casing of claim 1 wherein:

the first end of the casing tube has a flat base and comprises a ring shaped corrugation which encircles the orifice; and the corrugation extends from the base in a direction away from the head cap to define an annular gap between the casing tube base and head cap.

8. The cartridge casing of claim 1 wherein the cartridge casing is configured for use in a rifled barrel of a gun or firearm.

9. The cartridge casing of claim 1 wherein the walls of the casing tube define a chamber configured to contain a pressure of up to 500 MPa.

10. A cartridge comprising a projectile mounted to the cartridge casing of claim 1.

11. A method of manufacturing a cartridge casing, the method comprising:

forming a casing tube including a metal or a metal alloy by a first process, the casing tube having a turn at a first end to provide a corner edge with an arcuate cross-section, wherein walls of the casing tube turn at the corner edge to define the first end of the casing tube;

forming a head cap by a second process, the head cap provided with an integral shoulder edge; and joining the casing tube and head cap by third process, such that the first end of the casing tube abuts and is joined with the head cap such that the corner edge of the casing tube sits within the shoulder edge of the head cap, wherein an orifice in the first end of the casing tube is aligned with a passage in the head cap to define a flash passage, and wherein the head cap and casing tube are held together by a deformable member which provides a mechanical joint between the head cap and casing tube.

12. The method of claim 11 wherein the first process comprises:

providing a sheet of material; and deforming the sheet of material into a substantially cylindrical tube such that the cylindrical tube is closed at the first end and open at a second end opposite to the first end; and providing an orifice in the first end.

13. The method of claim 12 wherein the third process comprises:

providing a deformable region on the head cap configured to pass through the orifice in the first end of the casing tube; and deforming the deformable region to fix the casing tube and head cap together.

14. The method of claim 12 wherein the third process comprises:

providing a deformable member which extends through the orifice in the first end of the casing tube and the head cap passage;

deforming the deformable member to fix the casing tube and head cap together.

15. A cartridge casing comprising:

a casing tube including a metal or a metal alloy, the casing tube having a turn at a first end to provide a corner edge with an arcuate cross-section, the casing tube comprising a single wall, wherein the single wall of the casing tube turns at the corner edge to define the first end of the casing tube; and a head cap provided with an integral shoulder edge, wherein the first end of the casing tube abuts and is joined with the head cap such that the corner edge of the casing tube sits within the shoulder edge of the head cap, and such that an orifice in the first end of the casing tube is aligned with a passage in the head cap to define a flash passage; and wherein the head cap and casing tube are held together by a deformable member; and wherein the deformable member extends through the passage in the head cap and through the first end orifice to thereby define the flash passage, which provides a mechanical joint between the head cap and casing tube.

16. The cartridge casing of claim 15 wherein:

the first end of the casing tube has a flat base and comprises a ring shaped corrugation which encircles the orifice; and the corrugation extends from the base in a direction away from the head cap to define an annular gap between the casing tube base and head cap.

17. The cartridge casing of claim 15 wherein the cartridge casing is configured for use in a rifled barrel of a gun or firearm.

18. A cartridge comprising a projectile mounted to the cartridge casing of claim 15.

19. The cartridge casing of claim 1, wherein the shoulder edge of the head cap surrounds the corner edge of the casing tube when the first end of the casing tube is seated on the head cap.

20. The cartridge casing of claim 1 wherein the casing tube consists only of the metal, the metal alloy, or both the metal and the metal alloy.

21. The cartridge casing of claim 1 wherein each of the casing tube, the head cap, and the deformable member consist only of the metal, the metal alloy, or both the metal and the metal alloy.

* * * * *